United States Patent [19]

Kristofich

[11] Patent Number: 4,562,656

[45] Date of Patent: Jan. 7, 1986

[54] MOUNTING FRAMES

[76] Inventor: John F. Kristofich, 25 Jacob Rd., Washington Township, Warren County, N.J. 07882

[21] Appl. No.: 440,004

[22] Filed: Nov. 8, 1982

[51] Int. Cl.[4] ..... A47G 1/06; G09F 1/12

[52] U.S. Cl. ..... 40/152; 16/235; 16/254; 16/297; 248/460; 403/329

[58] Field of Search ..... 40/152.1, 152; 248/460; 16/221, 259, 230, 330, 235, 343, 254, 344, 277, 249, 261, 256, 297, DIG. 13, DIG. 26, DIG. 40; 403/49, 83, 84, 187, 326-330; 211/192, 148; 135/107

[56] References Cited

U.S. PATENT DOCUMENTS

| | | | |
|---|---|---|---|
| 20,436 | 6/1858 | Kinsley et al. | 40/152 |
| 253,730 | 2/1882 | Lueckel | 40/152.1 |
| 419,605 | 1/1890 | Hiller | 40/152.1 |
| 620,401 | 2/1899 | Almonte | 116/330 |
| 769,035 | 8/1904 | Walter | 16/330 |
| 905,951 | 12/1908 | Sturla | 40/152.1 |
| 1,356,039 | 10/1920 | Cartwright | 16/330 |
| 1,946,837 | 2/1934 | Clayton | 116/330 |
| 2,086,443 | 7/1937 | Rutyna | 40/152.1 |
| 2,207,836 | 7/1940 | Sundell | 16/254 |
| 2,317,708 | 4/1943 | Zareko | 40/152 |
| 2,367,071 | 1/1945 | Tarlitz | 40/152.1 |
| 2,616,197 | 11/1952 | Osburn | 16/221 |
| 3,041,763 | 7/1962 | Knox | 40/152.1 |
| 3,132,432 | 5/1964 | Yee | 40/152.1 |
| 3,590,419 | 7/1971 | Dargeng | 16/235 |
| 3,858,988 | 1/1975 | Cohen | 403/329 |
| 3,955,298 | 5/1976 | Kapstad | 160/381 |
| 4,100,633 | 7/1978 | Pintos | 135/107 |
| 4,193,164 | 3/1980 | Okayama | 16/DIG. 13 |
| 4,216,936 | 8/1980 | De Selms | 40/152.1 |

FOREIGN PATENT DOCUMENTS

| | | | |
|---|---|---|---|
| 254281 | 3/1912 | Fed. Rep. of Germany | 40/152 |
| 811369 | 6/1951 | Fed. Rep. of Germany | 40/152.1 |
| 691440 | 7/1930 | France | 40/152.1 |

*Primary Examiner*—Gene Mancene
*Assistant Examiner*—James Hakomaki
*Attorney, Agent, or Firm*—Edward M. Blocker

[57] ABSTRACT

A picture frame hinge. The hinge is attached to backs of picture frames by inserting projections which extend from the hinge leaves into corresponding holes in the backs of the picture frames. The hinge is held in place by a resilient tab. The hinge contains opposing radial teeth which are resiliently biased together, and permit positive adjustment of the viewing angle of picture frames. A prop, for free standing is also provided.

11 Claims, 14 Drawing Figures

FIG. 8
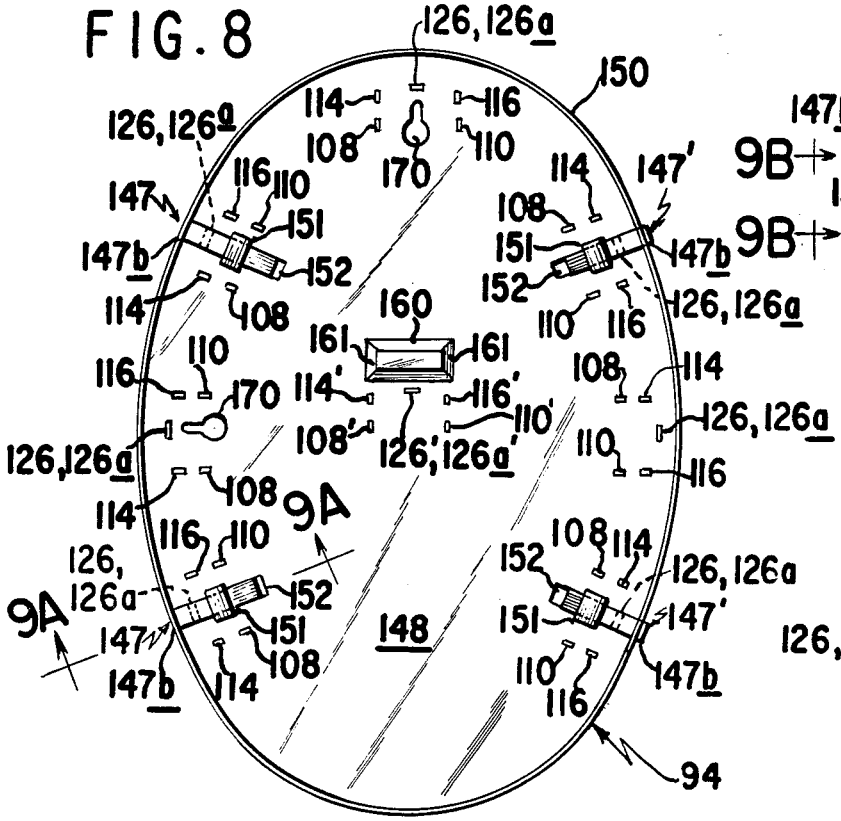
FIG. 9A
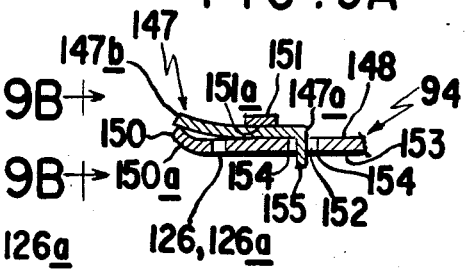
FIG. 9B
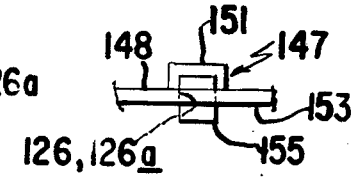
FIG. 10
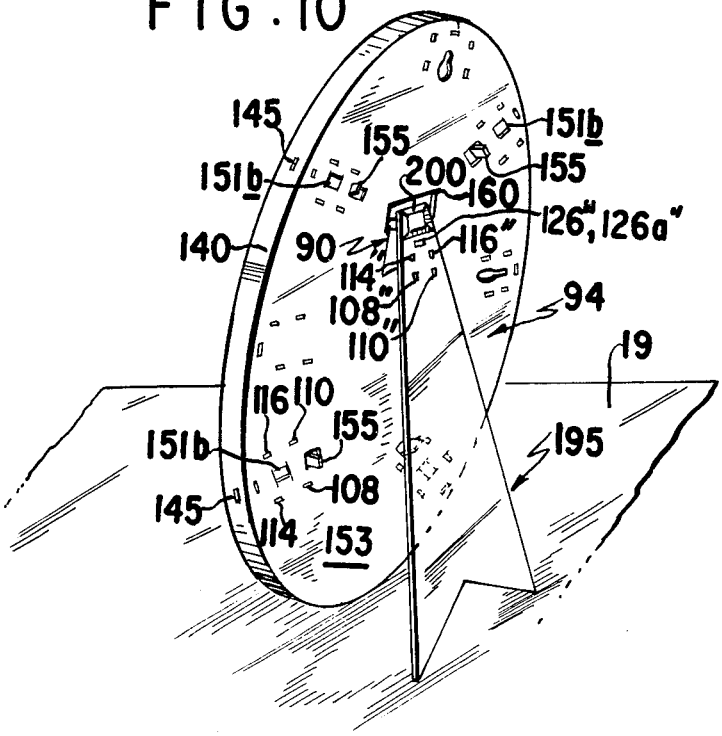
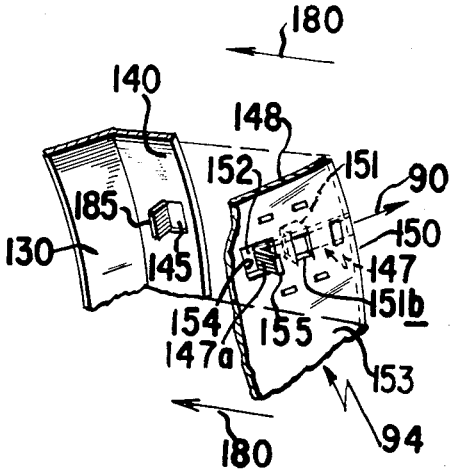
FIG. 11

MOUNTING FRAMES

BACKGROUND

The present invention relates to frames for mounting pictures and the like for display.

It is desirable to provide versatile frames for mounting pictures in any one of a variety of ways as the user may wish. For example, the user may want to connect the frames together for mounting on a wall in one of a variety of configurations; or he may wish to have the interconnected frames rest on a horizontal surface and angled with respect to one another, or else arranged geometrically, as in a cube or otherwise. Again, he may wish to utilize the frames individually, either to rest on a horizontal surface or to be mounted individually on a wall.

SUMMARY OF THE INVENTION

Accordingly, it is an object of the present invention to provide mounting frames adapted for use in a variety of ways.

It is a further object of the present invention to provide mounting frames adapted to be interconnected in a variety of user selectable dispositions in relation to one another.

It is yet another object to provide devices for use in interconnecting mounting frames in a variety of user selectable dispositions.

It is still another object to provide such mounting frames and devices that are easy to use and disengage, and are relatively inexpensive to manufacture.

In accordance with one aspect of the present invention, a mounting frame assembly is provided having first and second mounting frames, and means for interconnecting the first and second mounting frames. The interconnecting means is adapted for releasably securing the frames at a selectable one of a plurality of angular dispositions with respect to one another. The user may, secure the first and second mounting frames at the angular disposition that he desires and later rearrange the disposition of the frames in a different angular relationship, if he should wish to do so. In accordance with a further aspect of the present invention, an apparatus is provided for interconnecting mounting frames. The apparatus comprises a first means for affixing to a first mounting frame; a second means for affixing to a second mounting frame; and a third means for releasably securing the first and second means selectably at one of a plurality of angular dispositions to thereby releasably secure the first mounting frame at a selected angular disposition with respect to the second mounting frame.

In accordance with a further aspect of the present invention, a mounting frame assembly is provided comprising means for mounting an object for display and adapted to rest on a horizontal surface; and a prop rotatably affixed to the mounting means at a first end of the prop and having a second end adapted to rest on the surface for stabilizing the mounting means thereon. The mounting means has a catch provided thereon and the prop has attaching means adapted to cooperate with the catch for releasably securing the prop at its second end adjacent the mounting means in an inoperative disposition. The user, therefore, may either arrange the mounting frame on a horizontal surface with the aid of the prop, or else the prop may be releasably secured to the mounting means and the mounting frame mounted on a wall. The prop may be biased toward an operative position, for example, by a spring. When the user desires to mount the frame assembly on a wall, the prop may be secured to the mounting means in accordance with the present invention so that the spring-loaded prop does not interfere.

In accordance with yet another aspect of the present invention, a mounting frame assembly is provided, comprising first and second mounting frames; and means for interconnecting the first and second mounting frames. The first mounting frame has a first aperture for use in affixing the interconnecting means thereto, the first mounting frame having a lip on one side of the first aperture having an inwardly facing surface. The interconnecting means has a projection extending therefrom and adapted to be positioned against the inwardly facing surface of the lip. The interconnecting means has means for maintaining the projection against the inwardly facing surface to oppose the removal of the projection from the aperture of the second object thus to oppose removal of the interconnecting means from the first mounting frame. In accordance with still another aspect of the present invention, an apparatus is provided for interconnecting a first mounting frame and a second mounting frame. The second mounting frame has a first aperture for use in affixing the apparatus to the second mounting frame and the second mounting frame has a lip on one side of the first aperture having an inwardly facing surface. The apparatus comprises first means for affixing to the first mounting frame; and second means for affixing to the second mounting frame. The second means has a projection extending therefrom and adapted to be positioned against the inwardly facing surface of the lip. The second means is provided with means for maintaining the projection against the inwardly facing surface to oppose the removal of the projection from the aperture of the second mounting frame thus to oppose removal of the apparatus from the second mounting frame.

In accordance with a still further aspect of the present invention, a mounting frame assembly adapted to rest on a horizontal surface or to be mounted on a wall is provided. The mounting frame assembly comprises a mounting frame having a lower edge; and at least one leg adapted for use in supporting the mounting frame on the horizontal surface. The leg is provided with means for releasably affixing the leg to the lower edge of the mounting frame. Where the mounting frame assembly has, for example, a curved lower edge, the provision of one or more legs to permit the mounting frame to rest on a horizontal surface is useful. If the user prefers, however, to mount the frame on a wall, the present invention permits the user to remove the legs to enhance the ornamental features of the mounting frame as it appears on the wall.

Further features and advantages of the invention will be apparent from the following detailed description of certain preferred embodiments, when taken in conjunction with the accompanying drawings.

BRIEF DESCRIPTION OF DRAWINGS

The present invention is illustrated by way of example and not limitation in the figures of the accompanying drawings in which like numerals indicate similar elements and in which:

FIG. 11 is a plan view of the back side of the mounting frame of FIG. 8, with its supporting prop retracted to an inoperative position;

FIG. 11A is a partially broken away, sectional view taken along the lines 11A—11A in FIG. 11;

FIG. 12 is a partially broken away, sectional view taken along the lines of 12—12 in FIG. 11.

DETAILED DESCRIPTION OF PREFERRED EMBODIMENTS

Figure 1:
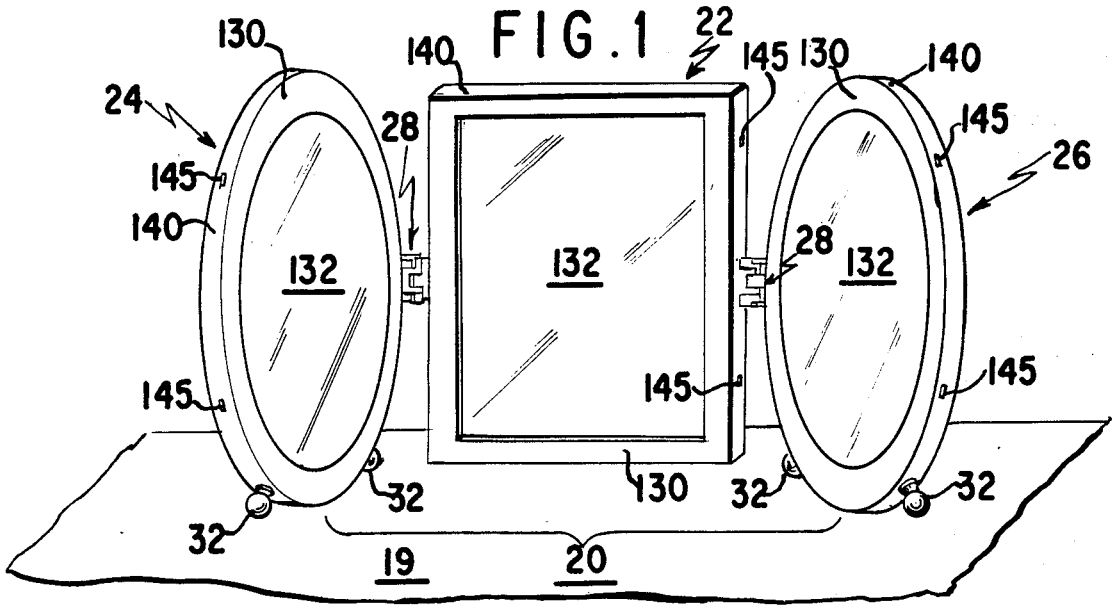
FIG. 1 is a perspective view of a number of interconnected mounting frames adapted to be releasably secured at selectable angular dispositions with respect to one another.

FIG. 1 illustrates a mounting frame assembly 20 resting on a horizontal surface. The assembly 20 includes a rectangular picture frame 22 and two oval picture frames 24 and 26, one on either side of frame 22. Each of oval frames 24 and 26 is interconnected with frame 22 by means of a respective one of interconnecting hinges 28, discussed in greater detail below.

Figure 2:
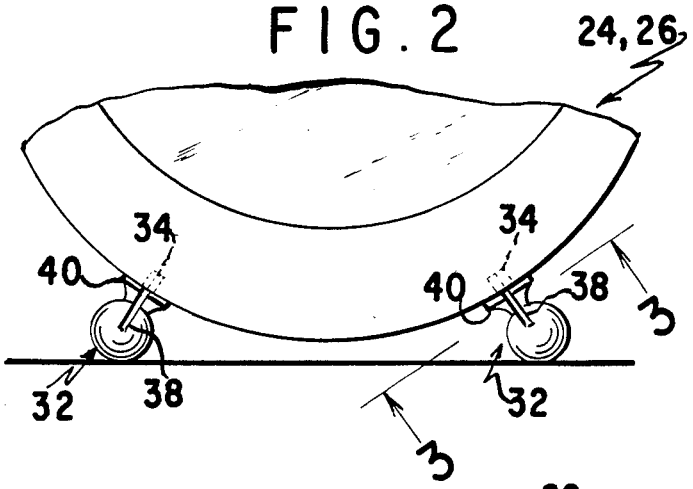
FIG. 2 is a partially cut away, plan view of one of the outside mounting frames of FIG. 1 illustrating the provision of removable legs for use in resting the frame on a horizontal surface.
Figure 3:
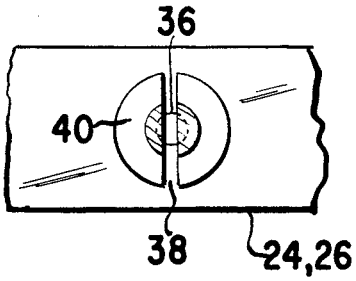
FIG. 3 is a sectional view taken along the lines 3—3 in FIG. 2.

Each of oval picture frames 24 and 26 is provided with a pair of legs 32 for use in supporting the picture frame on the horizontal surface. With reference to FIG. 2, the lower portion of one of oval picture frames 24 and 26, with two legs 32 affixed thereto for supporting the frame 24 or 26 is illustrated. The legs 32 are releasably affixed to the frame 24 or 26, so that if the user wishes to mount the frame on a wall instead of resting it on a horizontal surface, the legs 32 may be removed to enhance the ornamental appearance of the frame. Referring also to FIG. 3, each of legs 32 is provided with an insert 34 adapted to be positioned in a corresponding aperture 36 in the frame 24 or 26 for releasably affixing the leg 32 to the frame. Each leg 32 is provided with a slot as shown at 38, the slot extending through the insert 34, so that the insert is resiliently collapsible. The insert 34 is shaped and dimensioned so that it may be collapsably forced into the aperture 36 to exert pressure thereagainst when positioned in the aperture 36 to resist removal therefrom. Each of legs 32 includes a flange 40 adajcent the insert 34. The flange 40 serves as a stop against the frame 24 or 26 limiting the insertion of the leg thereinto and providing support to the frame.

Figure 4:
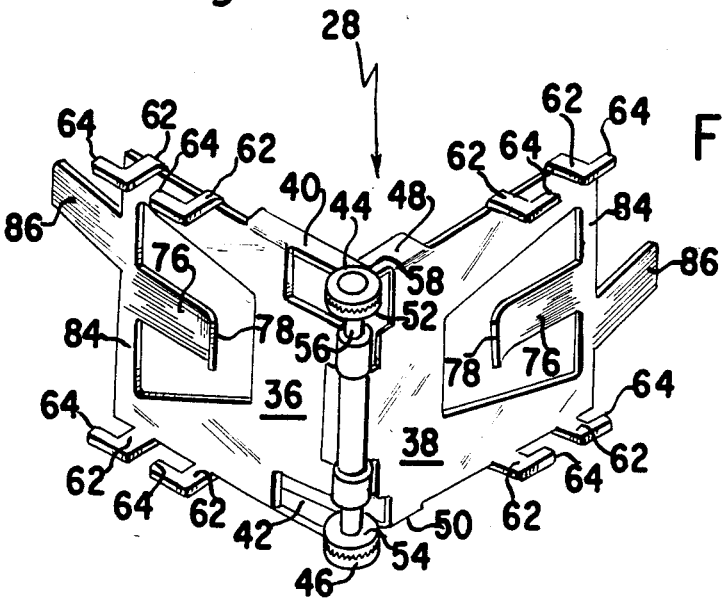
FIG. 4 is a perspective view of an apparatus for interconnecting the mounting frames as shown in FIG. 1 and for releasably securing the frames at a selectable one of a plurality of angular dispositions.

One embodiment of the interconnecting hinge 28 is illustrated in FIG. 4. The hinge 28 includes a first member 36 adapted to be releasably affixed to a first picture frame and a second member 38 adapted to be releasably affixed to a second picture frame. Members 36 and 38 may be made, for example, of No. 1095 metal alloy, heat treated to spring temper.

Member 36 has two portions 40 and 42 each bent toward the other and at right angles to member 36. Each of portions 40 and 42 has a rounded end 44 and 46, respectively, provided with a number of radiating teeth on a surface thereof facing inwardly toward the corresponding surface of the other end 44 or 46. Member 38 includes two portions 48 and 50 each bent toward the other and at right angles to member 38. Each of portions 48 and 50 has a rounded end 52 and 54, respectively, having a surface facing outwardly and provided with a number of radiating teeth meshed with the teeth of a corresponding one of rounded ends 44 and 46. Accordingly, each of rounded ends 44, 46, 52 and 54 comprises a locking gear or serrated disk meshed with a corresponding one of the rounded ends.

Each of the gears has a central aperture through which an axel 56 extends. Axel 56 is flattened at both ends, for example, as shown at 58, to maintain the axel in place.

Each of portions 40 and 42 is biased against the corresponding one of portions 48 and 50, so that the meshed gears resist rotation with respect to one another on the axel 56. However, if sufficient force is applied to the members 36 and 38, the teeth of the gears will slide over one another to permit the members 36 and 38 to rotate with respect to one another and assume a new angular disposition.

Each of members 36 and 38 is provided with two pairs of legs 62, each pair being located on a respective side edge of its member 36 or 38. Each leg has a projection 64 extending parallel to its respective member 36 or 38. Legs 62 are useful for affixing the members 36 and 38 each to a corresponding picture frame 22, 24 or 26, as shown in FIG. 1.

Figure 5:
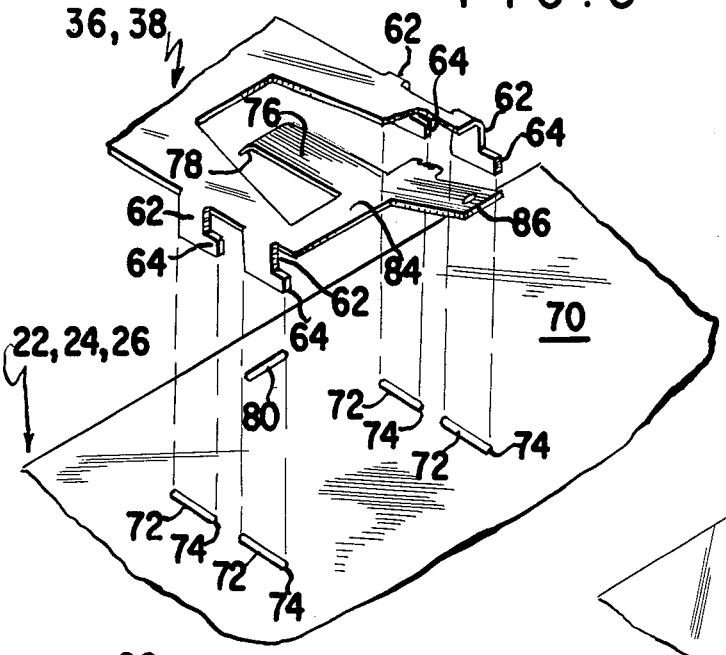
FIG. 5 is a partially cut away view of a portion of the apparatus of FIG. 4 illustrating the manner in which the apparatus is releasably secured to one of the mounting frames.
Figure 6B:
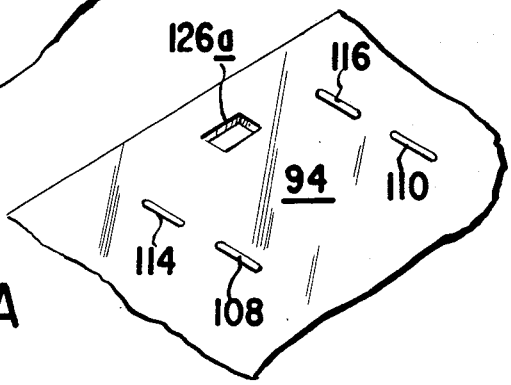
FIG. 6 is a partially cut away view of a modified apparatus for use in interconnecting mounting frames.
Figure 6A:
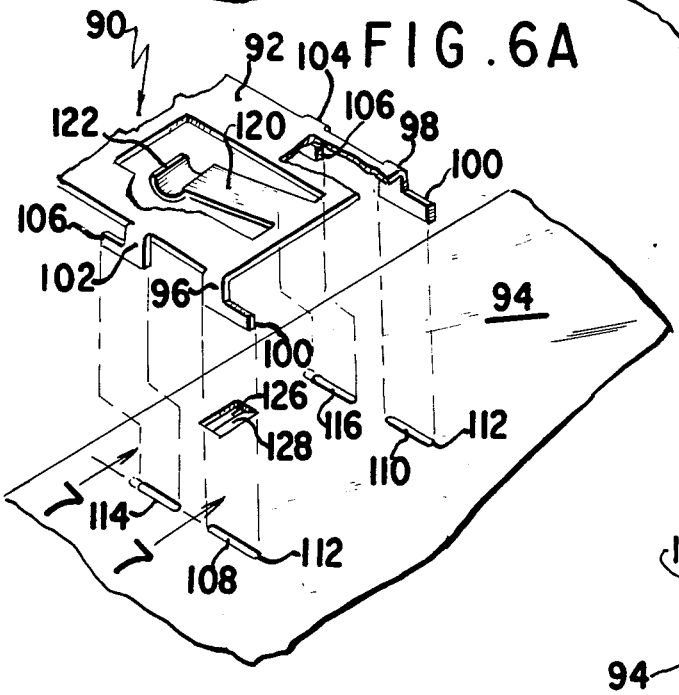
Figure 7A:
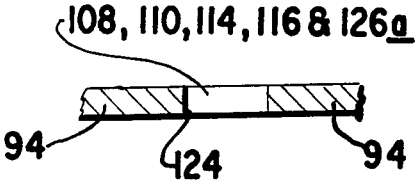
FIG. 7 is a partially broken away, sectional view taken along the lines 7—7 in FIG. 6.
Figure 7B:
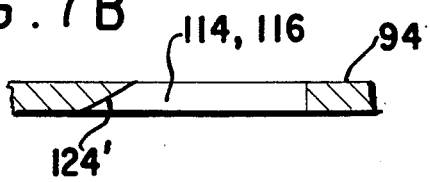

FIG. 5 illustrates the manner in which a member 36 or 38 is affixed to a picture frame 22, 24 or 26. The picture frame is provided with a back cover 70 made of sheet metal such as aluminum. Four apertures 72 are stamped in cover 70. Apertures 72 are sized and positioned to permit each leg 62 with its projection 64 to be inserted into a corresponding aperture 72. Each aperture 72 has a lip 74 at one side of the aperture. After the legs 62 are fully inserted in apertures 72, the member 36 or 38 is slid to position each of the projections 64 against an inner surface of the lip 74 of the respective aperture 72.

With reference to both of FIGS. 4 and 5, each of members 36 and 38 is provided with a leg 76 having a projection 78 extending in a generally opposite direction to that in which the projections 64 extend and toward the back cover 70 when the member 36 or 38 is positioned for coupling therewith. Back cover 70 is provided with an aperture 80 sized and positioned so that, when projections 64 are fully inserted under the lips 74, projection 78 snaps into aperture 80 to oppose the removal of projections 64 from engagement with the inner surfaces of lips 74. It will be appreciated that it is relatively easy in this manner to secure the members 36 and 38 to the frames 22, 24 and 26, thus to interconnect the frames, for example, as shown in FIG. 1. When thus connected by the interconnecting hinge 28, the frames may be releasably secured at a selected angular disposition with respect to one another simply by applying a force to the frames which overcomes the resistance of the gears of hinge 28.

Each leg 76 is mounted on a torsion bar 84 of the member 36 or 38. A tab 86 is mounted on a side of torsion bar 84 opposite the leg 76 and angled slightly with respect to the member 36, 38 so that the tab 86 is raised slightly from back cover 70 when the member 36 or 38 is coupled therewith. Tab 86 provides the user with a convenient means of removing the projection 78 of leg 76 from aperture 80 to permit the decoupling of the member 36 or 38 from the frame. This is accomplished by pressing the tab toward the cover 70 thus applying a moment through torsion bar 84 to pull projection 78 from aperture 80, whereupon the legs 64 may be removed from apertures 72.

Figure 6:
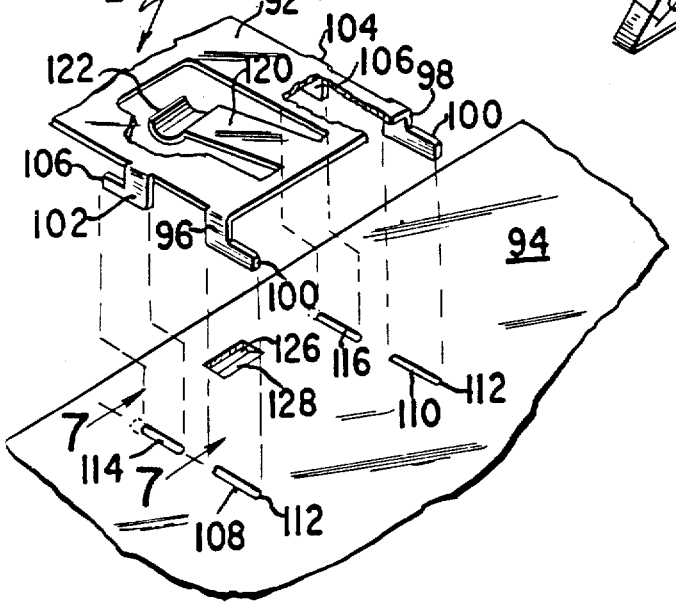
Figure 7:
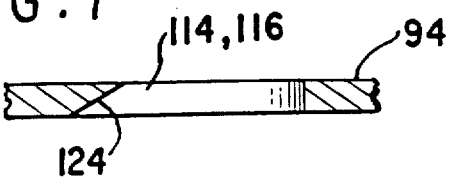

With reference now to FIGS. 6 and 7, a partial view of a further embodiment 90 of an interconnecting hinge is provided for use in interconnecting picture frames such as frames 22, 24 and 26 of FIG. 1. A member 92 is adapted to connect the hinge 90 to a back cover 94 of a picture frame. Hinge 90 also includes a second member (not shown), which may be constructed in the same manner as member 92, for use in affixing the hinge 90 to a second picture frame. Hinge 90 further includes a rotatable, geared mechanism (not shown) such as that included in hinge 28 of FIG. 4. Member 92 may be made, for example, of No. 1095 metal alloy, heat treated to spring temper.

Member 92 includes first legs 96 and 98 each extending from a respective side of member 92 at a right angle thereto. Each of legs 96 and 98 has a projection 100 which extends in a first direction parallel to member 92. Member 92 also includes second legs 102 and 104 each extending from a respective side of member 92 at a right angle thereto. Each of legs 102 and 104 has a projection 106 which extends in a second direction opposite to the first direction and parallel to member 92.

To affix the member 92 to the back cover 94, the user first inserts legs 96 and 98 into corresponding apertures 108 and 110 in back cover 94 (as shown by phantom lines in FIG. 6) and slides the projections 100 under lips 112 of apertures 108 and 110. Back cover 94 also includes apertures 114 and 116 sized and positioned so that, when projections 100 of legs 96 and 98 have been fully inserted under lips 112, legs 102 and 104 may be inserted in the apertures 114 and 116, respectively.

In order to maintain the projections 100 under the lips 112, and thus to prevent removal of the member 92 from the back cover 94, member 92 is also provided with a leg 120 affixed to member 92 at one end of leg 120, leg 120 being angled from member 92 slightly toward the back cover 94 when member 92 is aligned for coupling therewith. Leg 120 is made of spring metal to permit it to bend resiliently. At an opposite end of leg 120 a rounded projection 122 extends a convex surface thereof toward back cover 94 when member 92 is aligned for coupling with cover 94.

To complete the coupling of member 92 with back cover 94 after the insertion of legs 96 and 98 in apertures 108 and 110, the user then inserts legs 102 and 104 into apertures 114 and 116 which brings the convex surface of projection 122 of leg 120 into contact with back cover 94. The user then slides the member 92 in a direction opposite to that used to insert the projections 100 under lips 112. With reference also to FIG. 7, each of apertures 114 and 116 has an inwardly facing lip 124 angled with respect to the aperture so that the projection 106 is forced under cover 94 and leg 120 is forced toward member 92 resiliently. Back cover 94 is also provided with a depression 126 having a sloped edge 128 positioned to intercept projection 122 of leg 120 as the projections 106 of legs 102 and 104 slide over surfaces 124. Depression 126 is sized to permit projection 122 to slide over edge 128 into the depression. Depression 126 is made sufficiently shallow so that leg 120 remains bent slightly so that leg 120 together with legs 102 and 104 clip onto cover 94. The dimensions of the various elements are selected so that, when projection 122 is fully extended into depression 126, projections 100 remain at least partly under the lips 112.

It will be appreciated that when the user wishes to remove the member 92 from the back cover 94, he may do so readily by sliding member 92 in the first direction used to insert projections 100 under lips 112, which draws projection 122 from depression 126 over its sloped edge 128 and then lifting legs 102 and 104 from apertures 114 and 116. Legs 96 and 98 may then be removed readily from apertures 108 and 110.

Figure 8:
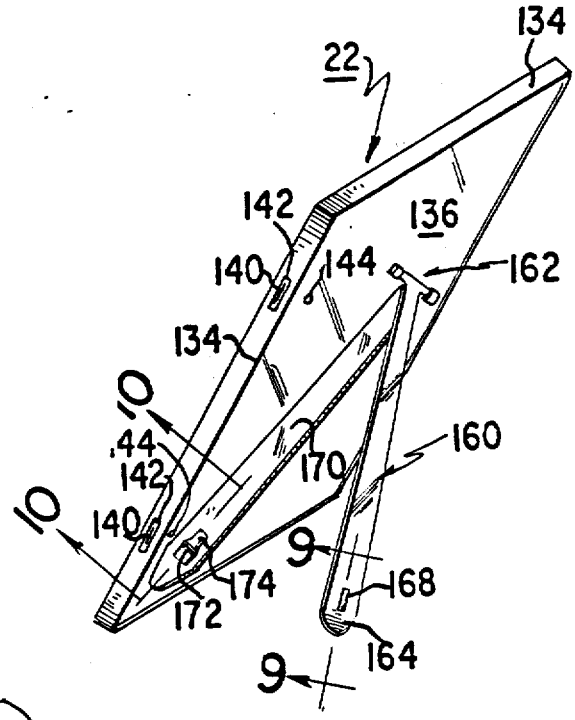
FIG. 8 is a perspective view of the back side of a mounting frame resting on a horizontal surface.

With reference again to FIG. 1, picture frame 22 includes a face 130 and a glass faceplate 132 held in frame 22 at its edges by face 130. Face 130 may be made, for example, of brass, steel, copper, nickel/silver, gold or any other suitable material. With reference also to FIG. 8, face 130 has a rearwardly extending, four sided skirt 134 extending about the four sides of face 130. Frame 22 also includes a back cover 136 sized and shaped to fit within the four sides of skirt 134. Cover 136 includes a plurality of tabs 140 along its edges and extending outwardly therefrom and adapted to fit within corresponding apertures 142 in the skirt 134 to interconnect the face and the back cover 136. A plurality of apertures 144 are provided in back cover 136, each aperture 144 being positioned adjacent a respective tab 140 to permit the user to remove the tabs 140 from the apertures 142 with the use of a narrow instrument inserted in the apertures to pry the back cover 136 from the face 130, for example, to replace a picture in the frame.

With reference also to FIGS. 11 and 11A back cover 136 is also provided with four forwardly facing projections 146 made, for example, with a stamping press. Projections 146 serve to press a cardboard backing 148 and picture 150 against the front plate 132, while the face 130 exerts a counterforce against the plate 132 to secure the picture 150 against motion within the frame 22.

With reference to FIG. 11, a plurality of apertures 154 are spaced about the edges of back plate 136 to permit the frame 22 to be interconnected to other picture frames, for example, as shown in FIG. 1. The frames may be interconnected, for example, with the use of the interconnecting hinge of FIGS. 4 and 5 or that of FIG. 6. The dimensions and positions of the various apertures 154 are selected in accordance with the selection of the hinge. It will be appreciated that various configurations of picture frame assemblies may be made by the user in this manner. For example, the picture frames may be disposed at various angles either toward or away from the viewer, or else the assembly may be arranged to form a geometrical figure, such as a square, triangle, hexagon, etc. Moreover, the picture frames and interconnecting devices of the present invention may be used to arrange the frames side by side at various relative elevations or arranged one above the other for display on a wall. For this purpose two further apertures 156 are provided in back plate 136 for hanging the frame 22 on a nail driven in the wall.

FIG. 8 illustrates the picture frame 22 resting on a horizontal surface. To stabilize the frame 22 on the surface, a prop 160 has a first end rotatably mounted in a bearing 162 formed in the back cover 136 and a second end 164 adapted to rest on the horizontal surface. Prop 160 is urged outwardly from back cover 136 by a leaf spring (not shown) to maintain the prop in position to stabilize frame 22.

The outward rotation of the prop is limited by the construction of the first end of prop 160 and the bearing 162. The first end is generally T-shaped and flattened. Each wing of the T is fitted into the bearing which is wider in the plane of the back cover 136 than perpendicular thereto, the perpendicular width being chosen smaller than the width of the wings of the T. Accordingly, as the prop rotates outwardly of the cover 136, under the influence of the spring, the wings become wedged between opposite sides of the bearing, thus to prevent further rotation of the prop 160.

Figure 9:
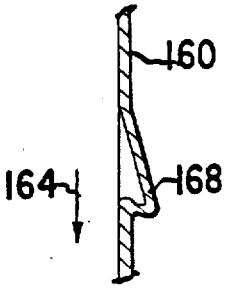
FIG. 9 is a partially broken away, sectional view taken along the lines 9—9 in FIG. 8.
Figure 10:
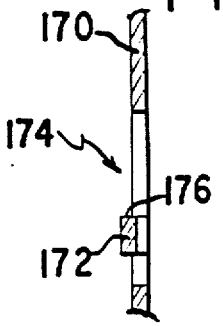
FIG. 10 is a partially broken away, sectional view taken along the lines 10—10 in FIG. 8.

With reference both to FIGS. 8 and 9, the second end 164 of prop 160 is provided with a projection 168 stamped in the prop 160 and extending toward the back cover 136. Back cover 136 is provided with a depression 170 sized and shaped to permit prop 160 to be pressed thereinto when it is desired to mount the frame 22 on a wall. With reference also to FIG. 10, back cover 136 has a raised bar 172 spanning an aperture 174 in the depression 170. Bar 172 is positioned to intercept the projection 168 at a first side of a lip 176 of bar 172 when the prop 160 is pressed into depression 170. Back cover 136 and prop 160 are made of metal (e.g., aluminum, brass, steel, copper, nickel/silver, or gold) sufficiently resilient to permit the projection 168 to slide over the lip 176 to a second side thereof opposite the first side, as shown in FIG. 12, thus to oppose the removal of the prop 160 from the depression 170. Aperture 174 serves to permit the projection 168 to pass under bar 172 without abutting back plate 136 beneath bar 172. The prop 160 in this inoperative disposition is prevented from interfering in the mounting of frame 22 on a wall, if so desired. It will be appreciated that the prop 160 is readily secured to the back plate 136 in this manner.

The end 164 of prop 160 is bent slightly away from back plate 136. When the user wishes to release the prop 160 from the depression 170 for mounting the frame on a horizontal surface, he need only insert a fingernail between end 164 and depression 170 and pull the prop outwardly. This force will cause the projection 168 to slide over bar 172, whereupon the spring will force the prop outwardly to its operative position. It will be readily appreciated that it is thus easy for the user to bring the prop 160 to its operative position.

The terms and expressions which have been employed are used as terms of description and not of limitation, and there is no intention in the use of such terms and expressions of excluding any equivalents of the features shown and described, or portions thereof, it being recognized that various modifications are possible within the scope of the invention claimed.

I claim:

1. For interconnecting a first picture frame and a second picture frame together in which each picture frame has a back cover which includes a front surface, a rear surface, first aperture means and second aperture means, said first aperture means and second aperture means extending from the front surface to the rear surface of each back cover; an apparatus comprising:

first leg means operable for traveling through said first aperture means and for affixing the apparatus to the back covers of the first picture frame and second picture frame; and second leg means operable for insertion within said second aperture means and for preventing the removal of said first leg means from said first aperture means so as to secure the apparatus to the back covers.

2. An apparatus as in claim 1; wherein said second leg means are of resilient material; wherein said second aperture means have outwardly facing walls sloping from the rear surfaces toward the front surfaces of said back covers; and wherein said second leg means upon insertion within said second aperture means are pressed against said outwardly facing walls.

3. An apparatus as in claim 1; wherein said first aperture means have rearwardly facing walls sloping from the front surfaces toward the rear surfaces of said back covers for aiding the travel of said first leg means through said first aperture means.

4. The apparatus of claim 1, further comprising gear means for releasably securing the apparatus to the first and second picture frames selectably at one of a plurality of angular dispositions to thereby releasably secure the first picture frame at a selected angular disposition with respect to the second picture frame.

5. The apparatus as in claim 4, wherein the apparatus further comprises a first member and a second member, said first leg means and second leg means integral with both said first member and said second member; and wherein the gear means comprises first gears affixed to the first member, and second gears affixed to the second member, the first and second gears being urged resiliently into meshed relationship so that upon the application of sufficient rotational force, the gears will slip over one another to permit rotation of the first member relative to the second member.

6. An apparatus as in claim 1; wherein the second leg means comprises a torsion bar and tab means for applying a movement to the torsion bar to urge the second leg means outwardly from the second aperture means for disengagement therefrom.

7. An apparatus as in claim 6, wherein the means for applying comprises a tab affixed to the torsion bar and projecting therefrom, whereby the tab may be pressed to apply a moment to the torsion bar.

8. An apparatus as in claim 1; wherein the second leg means comprises user actuable means for rendering the second leg means inoperative such that the first leg means may be selectably disengaged from the first aperture means.

9. An apparatus as in claim 1; wherein said apparatus further comprises mounting means for mounting an object for display and for resting on a horizontal surface, said mounting means having a catch; and a prop having a first end rotatably affixed to the mounting means, having a second end operable for resting on the horizontal surface so as to stabilize the mounting means thereon and having attaching means operable for releasably securing the prop to the mounting means wherein one of said catch and attaching means includes a lip having a first side located opposite a second side thereof and wherein the other of said catch and attaching means includes a projection; said projection being operable to slidably travel over and beyond said lip coming into contact first with said first side of said lip and then with said second side of said lip.

10. The frame assembly of claim 9, wherein the projection upon traveling beyond the lip abuts the second side of the lip such that the second end of the prop is releasably secured to the mounting means.

11. An apparatus as in claim 5; wherein said first leg means comprise two pairs of legs; the first pair of legs extending in a direction opposite to the direction in which the second pair of legs extend.

* * * * *

UNITED STATES PATENT AND TRADEMARK OFFICE

CERTIFICATE OF CORRECTION

PATENT NO. : 4,562,656

DATED : January 7, 1986

INVENTOR(S) : John F. Kristofich

It is certified that error appears in the above-identified patent and that said Letters Patent are hereby corrected as shown below: In the drawings Substitute Figures 6A, 6B, 7A, 7B, 8, 9A, 9B, 10 and 11 with Figures 6, 7, 8, 9, 10, 11, 11A and 12 attached hereto.

Signed and Sealed this

Tenth Day of February, 1987

*Attest:*

DONALD J. QUIGG

*Attesting Officer*

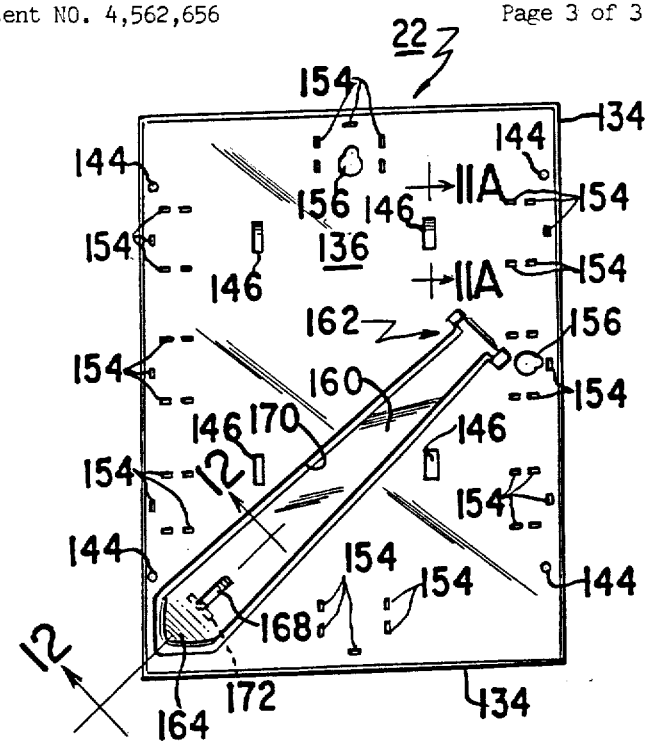
FIG. 11
FIG. 11A
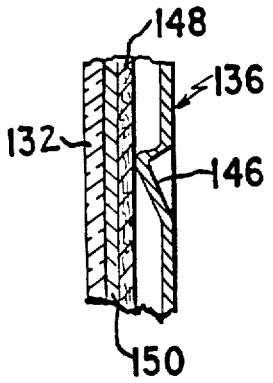
FIG. 12
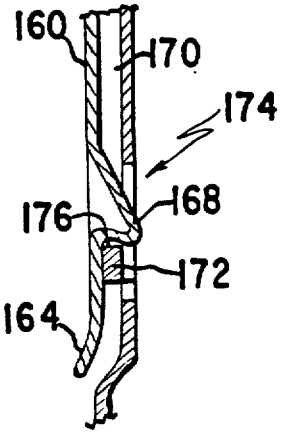

*Commissioner of Patents and Trademarks*